United States Patent [19]

Kapit

[11] 3,964,110

[45] June 22, 1976

[54] PORTABLE UNISEX URINAL

[76] Inventor: Wynn Kapit, 2452 15th St., San Francisco, Calif. 94114

[22] Filed: June 18, 1975

[21] Appl. No.: 587,832

[52] U.S. Cl. ..... 4/99; 4/102

[51] Int. Cl.[2] ..... A47C 29/00

[58] Field of Search ..... 4/1, 6, 7, 99, 97, 98, 4/102

[56] References Cited

UNITED STATES PATENTS

| | | | |
|---|---|---|---|
| 3,183,525 | 5/1965 | O'Brien et al. | 4/99 X |
| 3,412,408 | 11/1968 | Michal, Jr. | 4/99 |
| 3,490,080 | 1/1970 | Sypal | 4/6 |
| 3,541,613 | 11/1970 | Sypal | 4/6 |
| 3,742,522 | 7/1973 | Stevenson | 4/102 |

*Primary Examiner*—Henry K. Artis

*Attorney, Agent, or Firm*—William R. Piper

[57] ABSTRACT

A portable unisex urinal that can be removably attached to a bathroom fixture, such as a bathtub and can be used by both males and females. The purpose of the device is to use far less water for flushing the urinal after it is used than is required to flush a standard toilet. Also, my device has a drain tube that may be connected to a standard drain already provided, such as the drain for a bathtub to which the device is attached. The portable urinal has a perforated hose extending around its rim and connectible to a removable water containing reservoir that has a manually controlled valve for delivering the desired volume of water into the hose for flushing the sides and bowl of the urinal after each use. The bowl is so shaped as to be readily useable by both sexes.

3 Claims, 4 Drawing Figures

PORTABLE UNISEX URINAL

SUMMARY OF THE INVENTION

An object of my invention is to provide a portable unisex urinal for the home or an apartment that is designed to use the existing drainage facilities. It is primarily designed to be removably secured to a bathtub, but it should not be restricted to such use. The urinal can be easily adjusted to a convenient height for the particular user, both male or female and it can be easily flushed clean after use with a minimal volume of water. A drain tube connects the urinal to the outlet drain for the bathtub. A weighted ring may be used at the free end of the drain tube for holding the tube in communication with the tub drain.

DESCRIPTION OF THE PREFERRED EMBODIMENT

Figure 1:
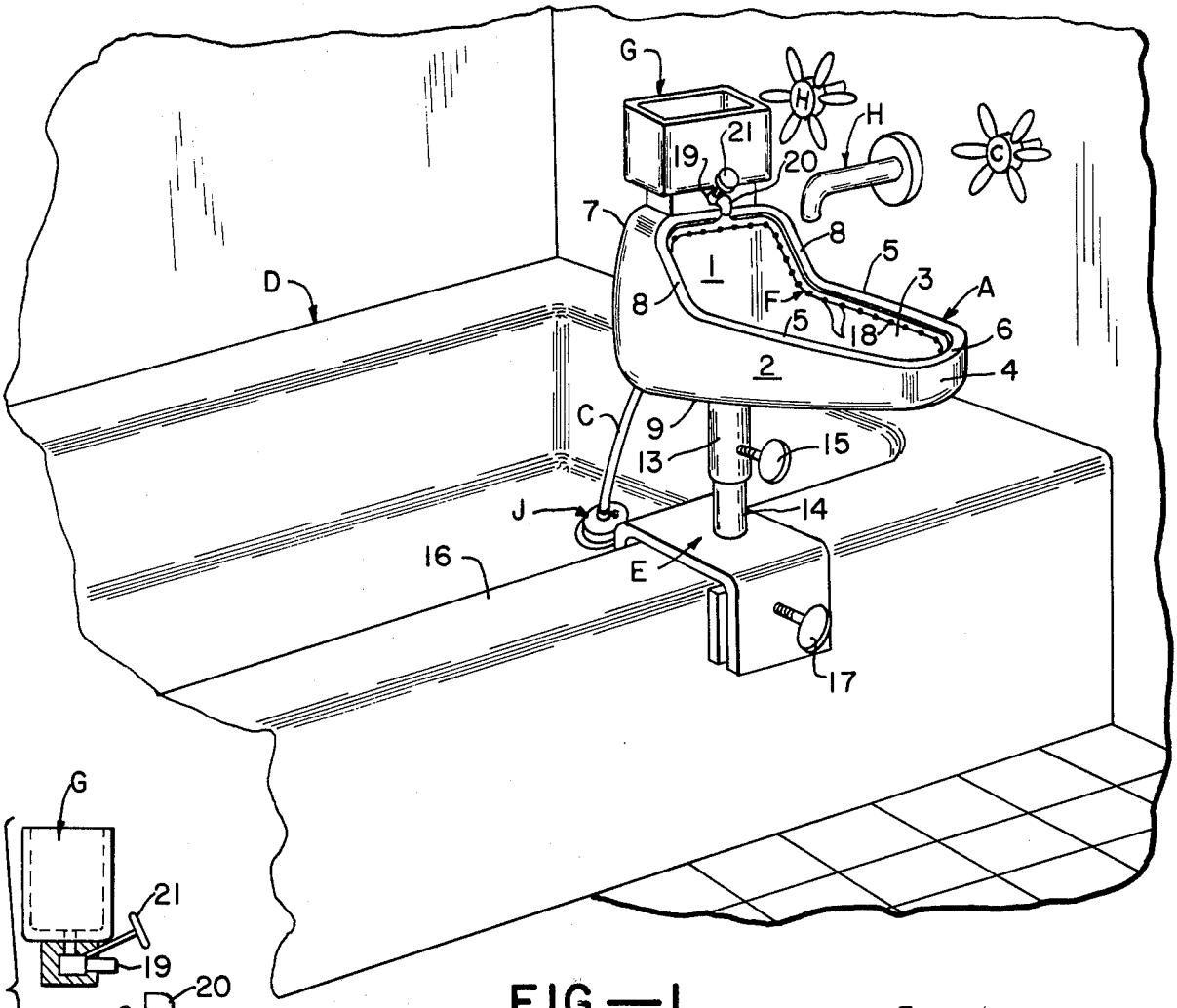
FIG. 1 is a perspective view of the portable unisex urinal shown applied to a side of a standard bathtub.
Figure 2:
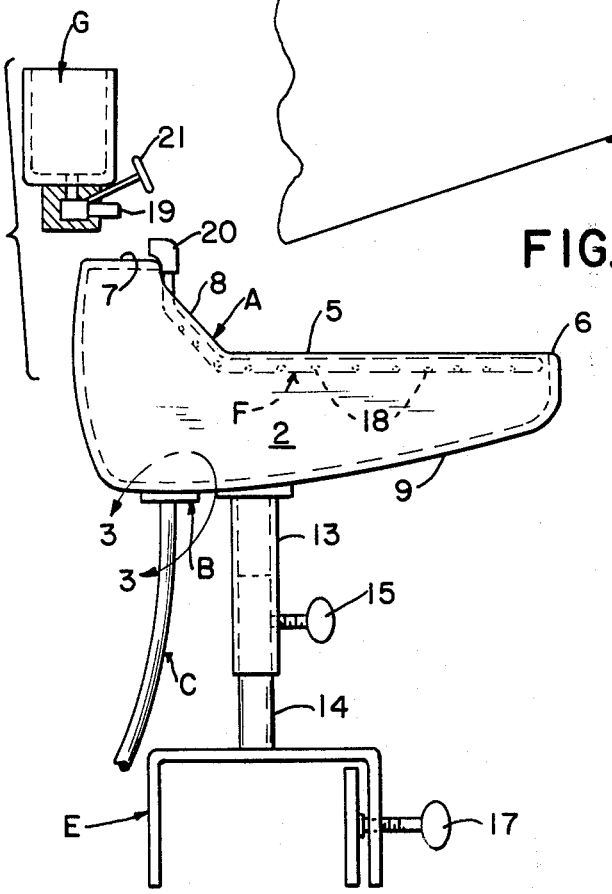
FIG. 2 is an exploded and enlarged side elevation of the device with a portion being shown in section.
Figure 3:
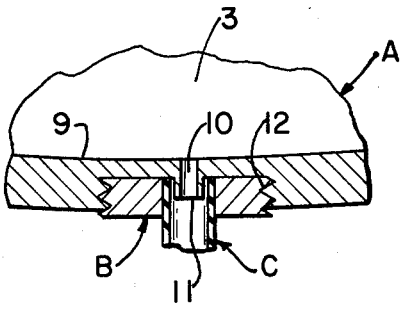
FIG. 3 is an enlarged longitudinal section through a portion of the urinal bowl that is enclosed by the arcuate dot-dash line 3—3 in FIG. 2. One end of the drainage tube is removably connected to the outlet of the urinal bowl.

In carrying out my invention I provide a portable urinal bowl of novel shape and indicated generally at A in FIGS. 1, 2 and 3. The bowl A has a relatively wide and high rear wall 1, slightly curved in vertical section and an elongated and tapering front portion with side walls 2 and 3 that are short in height at their forward ends and greatly increase in height where they merge into the relatively wide and high rear wall 1. This particular shape for the bowl provides an open top that extends from the short in height front wall 4, the rim 5 of the open top having a rounded front portion 6, the two sides of the rim gradually widening from the curved front 6, and rearwardly to provide an area that can be readily straddled by a female person who wishes to use the device.

The rear wall 1 is considerably higher than the front wall 4 and the rear portions of the side walls 2 and 3 that merge into the rear wall 1 are encreased in height so as to form side wall portions of the same height as the rear wall. Also, both FIGS. 1 and 2 show the top of the rear wall 1 provided with a substantially horizontal and forwardly extending top wall 7. The greater front part of the rim 5 lies in a substantially horizontal plane and then the two sides of the rim are inclined upwardly at a fairly steep angle at 8 to meet the forward edge of the horizontal top 7, see especially FIG. 2. The result is the provision of a cavity at the rear end of the bowl whose opened portion faces forwardly so as to permit a male person to straddle the elongated front portion of the bowl when using the device.

The bottom 9 of the bowl A is inclined downwardly at a slight angle from the front of the bowl rearwardly and the deepest portion of the bowl has an outlet passage 10, see FIG. 3, that communicates with an outlet extension 11. The bowl bottom 9 has a circular recess

12 whose rim is threaded to removably receive a ring or collar B. The collar B has a central bore for receiving an end of a drainage tube C that may be cemented or otherwise secured to the collar. The collar B is removably received in the recess 12 and it will register the inlet end of the tube C with the outlet extension 11 of the bowl A so that any fluid in the bowl will immediately drain into the tube C. Before describing how the drain tube C can deliver any fluid flowing therethrough into the standard drain, such as for a bathtub D, shown in FIG. 1, it is best first to describe the apparatus by means of which the bowl A is removably secured to a standard fixture, such as the bathtube D and how water is delivered into the bowl after each use for flushing the bowl.

Referring to FIGS. 1 and 2, I illustrate the bottom of the bowl A, as being provided with an integral and downwardly extending tubular member 13. This tubular member can be telescopied over an upwardly extending cylindrical member 14 of a bracket indicated generally at E. A screw clamp 15 is carried by the tubular member 13 and when the member 13 is adjusted to the proper height on the cylindrical member 14, the screw clamp 15 can be manually tightened for holding the parts in adjusted position. The cylindrical member 14 is integral with the bracket E which in turn is designed to fit over one side 16 of the bathtub, as shown in FIG. 1. A screw clamp 17 is carried by one side of the bracket E and it may be manually adjusted for clamping the bracket to the side of the bathtub D, or to any other fixture.

It is best now to refer to the structure which is used for flushing the urinal bowl A after each use. In FIGS. 1 and 2, I show a perforated hose F that is positioned on the inner side of the rim 5 for the bowl A. The outlet openings 18 in the hose F are arranged to direct the flushing water, entering the hose, in a downward direction against the inner surfaces of all of the walls surrounding the bottom of the bowl for cleaning the walls and bowl bottom before the water drains through the outlet passage 10 in the bowl and into the drainage hose C. The outlet openings 18 in the hose F are angled so that the jets of water issuing therefrom will merge with adjacent water jets to form a sheath of water that will flush all inner surfaces of the bowl and will ultimately drop vertically due to gravitational pull. This water movement will provide a sufficient overlap of water streams to insure the complete cleansing of the walls of the bowl.

I provide a removable water reservoir G that is designed to be supported by the top horizontal wall 7 of the urinal bowl A, see FIGS. 1 and 2. The reservoir has a valve-controlled outlet spigot 19 that is removably received in an elbow 20 which places the spigot in communication with the perforated hose F. A hand operated valve 21 for the spigot 19 controls the flow and the amount of water passing through the spigot and into the perforated hose. The reservoir G can be removed from the bowl A when it is desired to fill the reservoir with water from a source of water, such as from a faucet H for the bathtub D.

Figure 4:
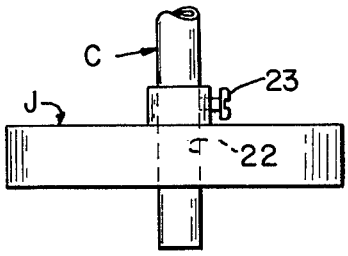
FIG. 4 illustrates how the other end of the drainage tube is removably connected to a weighted ring that holds the outlet end of the tube in communication with the drain of the bathtub.

If the device is clamped to the side 16 of the bathtub D, as shown in FIG. 1, the bowl A is adjusted to the correct elevation on the cylindrical upright member 14 and then is clamped in place by the screw clamp 15. FIG. 4 shows the free end of the drainage tube C provided with a weighted ring J that has a central opening 22 for slidably receiving the tube. A set screw 23 secures the weighted ring J to the tube C in adjusted position. The weighted ring is then placed over the drain outlet for the tub and will maintain the free end of the tube in communication with the drain so that all of the water that is flushed into the bowl A by opening the valve 21, will flow through the perforated hose F and out through the openings 18 therein and into the bowl and thence out through the bowl drain 10 and into the tube C and finally from the tube and into the tub drain, not shown.

I have already described how the device can be used by both male and female persons. If the tube C becomes worn through use it can easily be removed by removing the threaded collar B from the bowl recess 12 and then a new tube can be substituted for the old one. Also, it is possible to interchange a tube C of one size to that of another size or length so that the correct diameter tube with the required length can be used according to the needs or limitations of the particular drainage facilities being used. It should be kept in mind that the outlet extension 11 for the bowl A actually enters the adjacent end of the drainage tube C and therefore there is no possibility of any urine seeping downwardly around the outlet 11 to the outer surface of the tube nor is there a possibility of the urine backing up the tube and entering the bowl. The weighted ring J can also be quickly changed from the old to the new tube. The weighted ring is adjusted on the tube C so that the end of the tube will not reach the water trap for the tub drain. The openings 18 in the perforated hose F are cut so as to direct streams of water at an angle to strike the inner side surfaces of the bowl A rather than be directed straight down against the bowl bottom.

The water reservoir G contains enough water for several flushings of the bowl A and yet the reservoir will hold a far less volume of water when full than that contained in the standard water tank for a toilet. The spigot 19 is designed to slip into the elbow 20 when the water filled reservoir is placed on the horizontal top wall 7 of the bowl. I do not wish to be confined to the exact showing of the spigot 19, the elbow 20 and the hand operated valve 21, since broadly speaking this structure discloses one way of removably connecting the reservoir G to the perforated hose F. Therefore any means for accomplishing this will suffice.

Water has become an expensive and often a scarce commodity in this country. My device will permit virtually every existing bathroom to be provided with an inexpensive urinal device that can be attached to a bathroom fixture having a waste water drain. The bowl is designed to be used by both sexes and the saving of water over the flushing of a standard toilet bowl is enormous. There are no installation problems when coupling the urinal to the standard drain for a bathroom fixture, such as a bathtub.

I claim:

1. A portable unisex urinal comprising:

a. a urinal bowl having an outlet;

b. adjustable means supporting said bowl and connecting it to a fixture having a drain;

c. a drain tube communicating with the outlet for said bowl and extending to the drain for conveying any liquid in the bowl to the drain;

d. said urinal bowl having a rim;

e. a perforated hose extending around the interior of the bowl and adjacent to the rim; and f. a water containing reservoir removably supported by said bowl and having an outlet valve connectible to said hose;

g. whereby said valve may be opened for feeding water from said reservoir into said hose, the perforations in said hose directing the water against the inner surfaces of said bowl for flushing the bowl.

2. A portable unisex urinal comprising a. a urinal bowl having an outlet;

b. adjustable means supporting said bowl and connecting it to a fixture having a drain;

c. a drain tube communicating with the outlet for said bowl and extending to the drain for conveying any liquid in the bowl to the drain;

d. the urinal bowl being shaped with a cavity at one end, the bowl having an elongated more shallow and narrow front portion;

e. said adjustable means permitting the height of the bowl to be adjusted so that a female person can straddle the narrow front portion of the bowl when using it;

f. said adjustable means for supporting said bowl and connecting it to a fixture including;

g. a tubular member depending from the bowl bottom;

h. a bracket adapted to be clamped to a fixture having a drain, said bracket having an upstanding member adapted to telescope within said tubular member; and i. clamping means for securing said tubular member to said upstanding member for securing the two members in adjusted position.

3. A portable unisex urinal comprising:

a. a urinal bowl having an outlet;

b. adjustable means supporting said bowl and connecting it to a fixture having a drain;

c. a drain tube communicating with the outlet for said bowl and extending to the drain for conveying any liquid in the bowl to the drain;

d. the urinal bowl being shaped with a cavity at one end, the bowl having an elongated more shallow and narrow front portion;

e. said adjustable means permitting the height of the bowl to be adjusted so that a female person can straddle the narrow front portion of the bowl when using it;

f. said adjustable means for supporting said bowl and connecting it to a fixture including;

g. a tubular member depending from the bowl bottom;

h. a weighted ring adjustably secured near the free end of said drain tube for holding said tube in registration with the drain for the fixture;

i. a threaded collar secured to the opposite end of said drain tube and removably receivable in a threaded recess in said bowl disposed at the bowl outlet;

j. whereby said drain tube can be removed from said bowl by removing said collar from said recess when desiring to replace said drain tube with another one.

* * * * *